US005410116A

United States Patent [19]

Ozawa et al.

[11] Patent Number: 5,410,116

[45] Date of Patent: Apr. 25, 1995

[54] GAS ISOLATED DISCONNECTING SWITCH AND GAS ISOLATED SWITCHING DEVICE

[75] Inventors: Jun Ozawa; Toshio Ishikawa; Yukio Kurosawa, all of Hitachi, Japan

[73] Assignee: Hitachi, Ltd., Tokyo, Japan

[21] Appl. No.: 879,997

[22] Filed: May 8, 1992

[30] Foreign Application Priority Data

May 8, 1991 [JP] Japan ..... 3-131592

[51] Int. Cl.[6] ..... H01H 33/64

[52] U.S. Cl. ..... 218/67; 518/1

[58] Field of Search ..... 200/144 R, 144 AP, 146 R, 200/146 A, 148 R, 148 A, 148 B, 148 J, 149 B, 151; 361/3, 4, 13, 9, 11, 58

[56] References Cited

U.S. PATENT DOCUMENTS 3,566,055 2/1971 Weston ..... 200/48

FOREIGN PATENT DOCUMENTS 2422246 2/1979 France ..... H01H 33/18
2511238 9/1975 Germany ..... H01H 33/18
61-66510 of 1986 Japan ..... H02B 13/06

OTHER PUBLICATIONS

Derwent Publications Ltd., London, GB; AN 86-128452 & JP-A-61 066 510 (Hitachi) 5 Apr. 1986 Abstract/FIG. 8.

FR-A-2 422 246 (Merlin Gerin) p. 5, line 11-line 39 FIG. 4.

Patent Abstracts of Japan, vol. 14, No. 168, (E-912) 30 Mar. 1990 & JP-A-20 24 927 (Toshiba) 25 Jan. 1990.

DE-A-2 511 238 (Fuji Electric Co. Ltd) FIGS. 3-5, 7-10.

*Primary Examiner*—A. D. Pellinen
*Assistant Examiner*—Michael A. Friedhofer
*Attorney, Agent, or Firm*—Antonelli, Terry, Stout & Kraus

[57] ABSTRACT

A gas isolated disconnecting switch is provided which performs a sufficient restriking surge suppressing function, induces no adverse effect on the operation of a circuit breaker disposed within the system and always enables the circuit breaker to surely interrupt a fault current. Under the closed condition of the gas isolated disconnecting switch, a main stationary member 6 engages with a main movable member 16 and an auxiliary movable member 17 with an auxiliary stationary member 8 respectively. Accordingly the portion of an auxiliary conductor 7 which passes through a cylindrical magnetic body 9 is short-circuited via the main stationary member 6 and the main movable member 16, and no influence is induced on the operation of the circuit breaker disposed in the system. During the opening operation of the disconnecting switch, the auxiliary movable member 17 disengages with a time delay. At this moment, the current flows through the portion of the auxiliary conductor 7 which passes through the cylindrical magnetic body 9 to thereby perform a sufficient restriking surge suppressing function.

10 Claims, 4 Drawing Sheets

GAS ISOLATED DISCONNECTING SWITCH AND GAS ISOLATED SWITCHING DEVICE

BACKGROUND OF THE INVENTION

The present invention relates to a gas isolated switching device which performs a restriking surge suppressing function during switching operation thereof and, in particular, relates to a gas isolated switching device suitable for a gas isolated disconnecting switch.

In a power generating station and a power transforming station, for example, the suppression of a surge voltage due to a so called restriking surge, which is caused through circuit opening and closing operations such as by a disconnecting switch, is a very important problem.

Therefore, as disclosed, for example, in JA-A-61-66510 (1986) the restriking surge due to the switching operation of a gas isolated disconnecting switch is conventionally suppressed by mounting a cylindrical magnetic body around the outer circumference of a conductive body subjected to a high voltage.

In the above conventional art, no special consideration is made with respect to the influence of an increase in inductance (impedance) caused by the existence of the cylindrical magnetic body for suppressing the restriking surge, thereby an additional recovery voltage is likely to be applied between the contacts of a circuit breaker when a current, such as a fault current is interrupted by the circuit breaker. As a result the problem arises that in some instances the circuit breaker cannot interrupt such fault current. Namely, after such fault current passes through the zero point a high recovery voltage appears between the contacts of the circuit breaker because of the increased inductance in the system, as a result and the circuit breaker occurs and current interruption fails.

SUMMARY OF THE INVENTION

An object of the present invention is to provide a gas isolated disconnecting switch and a gas isolated switching device or switch gear which do not affect the operation of a circuit breaker disposed in the system and which permit the circuit breaker to always interrupt a fault current reliably while providing a sufficient restriking surge suppressing function for the gas isolated disconnecting switch and the gas isolated switch gear.

For achieving the above object, a short-circuiting contact circuit is provided which bypasses a conductor portion where a magnetic body for suppressing a restriking surge is disposed within the switch gear, and the short-circuiting contact circuit is opened only when a line opening operation by the switch gear is performed.

Under a steady state in which the switch gear is closed, the short-circuiting contact circuit functions to bypass a fault current from the conductor portion where the magnetic body is provided. Namely, since the impedance of the conductor portion where the magnetic body is provided is larger than that of the short-circuiting contact circuit, under the steady state a substantial portion of current such as the fault current flows through the short-circuiting contact circuit, no increase in the inductance is caused and the additional increase of the recovery voltage possibly appearing between contacts of a circuit breaker disposed the in the system is eliminated.

On the other hand, during the line opening operation of the switch gear, since the short-circuiting contact circuit is opened, a restriking surge current flows through the conductor portion where the magnetic body is disposed, thereby the loss to the high frequency current components at the conductor portion which passes through the magnetic body is surely effected and the restriking surge voltage caused by the switching operation of the switch gear is sufficiently suppressed.

DETAILED DESCRIPTION OF THE EMBODIMENTS

Figure 1:
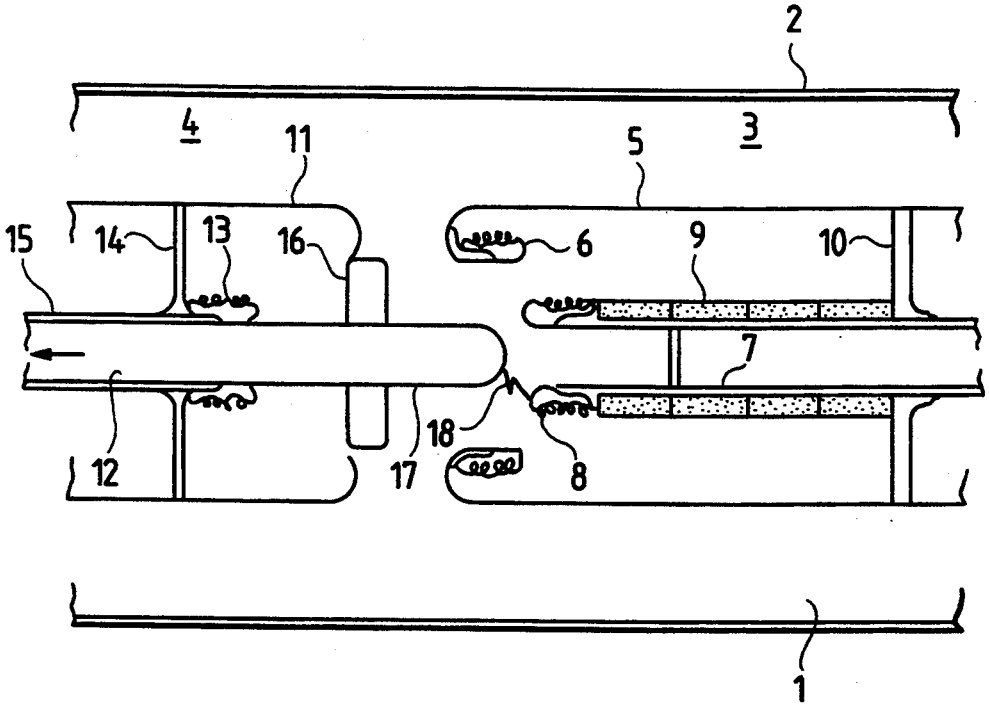
FIG. 1 is a lateral cross section showing one embodiment of gas isolated disconnecting switches according to the present invention.

Hereinbelow, gas isolated disconnecting switches and a gas isolated switch gear according to the present invention are explained in detail with reference to embodiments shown in the drawings.

FIG. 1 is an embodiment wherein the present invention is applied to a gas isolated disconnecting switch as will be apparent from the drawing, in the present embodiment, a gas isolated disconnecting switch is constituted by accommodating an electric line make and break portion constituted by a stationary member side 3 and a movable member side 4 in a grounded tank 2 in which SF6 (sulfur hexafluoride) gas 1 is filled.

Now, the stationary member side 3 is composed of a stationary member side conductor 5 serving as a shield, a main stationary member 6 provided thereon, an auxiliary conductor 7, an auxiliary stationary member 8 provided thereon and a cylindrical magnetic body 9 mounted on the circumference of the auxiliary conductor 7. The stationary member side. conductor 5 serves as a shield. It is connected to the auxiliary conductor 7 via a mounting bracket 10. The auxiliary conductor 7 extends to a bus-bar conductor (not shown) of the gas isolated disconnecting switch.

Further, the movable member side 4 is composed of a movable member side shield 11, a movable member 12, a contact piece 13, a mounting bracket 14 and a tube like conductor 15, and at the top end of the movable member 12 a main movable member 16 is provided. Further, an auxiliary movable member 17 is provided at the further top end of the movable member 12. In the disconnecting switch of FIG. 1 the main stationary member 6 constitutes a main stationary contact, the main movable member 16 a main movable contact, the auxiliary stationary member 8 an auxiliary stationary contact and the auxiliary movable member 17 an auxiliary movable contact.

Still further, FIG. 1 shows a condition wherein the disconnecting switch is on the way of opening. Therefore the movable member 12 is on the way toward the full open position and a generated restriking arc 18 is illustrated between contacts 8 and 17.

Subsequently, the operation of the present embodiment is explained together with the circuits shown in FIGS. 2(*a*), 2(*b*) and 2(*c*). The circuits each correspond to an equivalent circuit of the embodiment shown in FIG. 1, wherein, the numeral 20 represents a main contact which is constituted by the main stationary member 6 and the main movable member 16 and the numeral 21 represents an auxiliary contact which is constituted by the auxiliary stationary member 8 and the auxiliary movable member 17.

Further, the numeral 22 is a main circuit including the main contact 20, and the numeral 23 is an auxiliary circuit including the auxiliary contact 21. Still further, since the auxiliary circuit 23 includes the cylindrical magnetic body 9 the impedance thereof is high such that under the steady state wherein both the main contact 20 and the auxiliary contact 21 are closed and a substantial part of such as a fault current, for example, flows through the main circuit 22, therefore, the main circuit 22 constitutes a short-circuiting contact circuit in the sense of the present invention.

Figure 2:
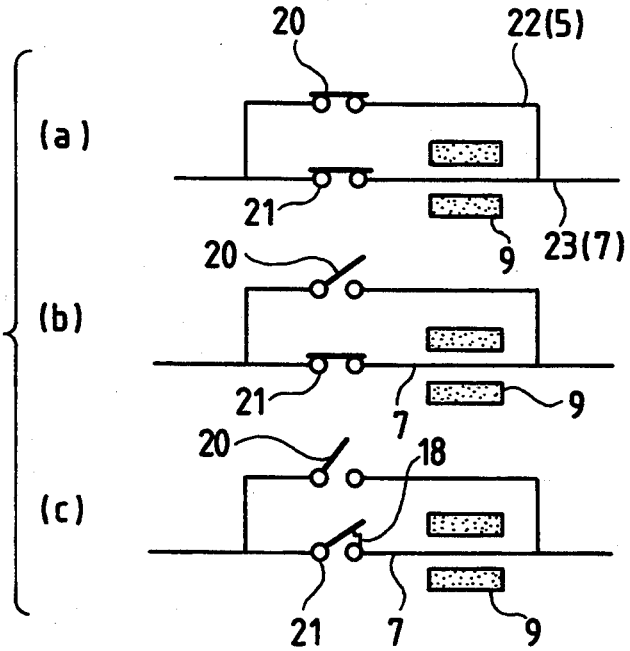
FIGS. 2(*a*), 2(*b*) and 2(*c*) are respective circuit diagrams for explaining the operation of the one embodiment according to the present invention.

First of all, FIG. 2 (*a*) illustrates a condition wherein the movable member 12 is displaced toward the right side and thereby the main movable member 16 engages with the main stationary member 6 and the auxiliary movable member 17 engages with the auxiliary stationary member. Accordingly, the circuit illustrates the condition wherein both the main contact 20 and the auxiliary contact 21 are closed. As indicated above, such condition is defined as a steady state in the present invention.

Under this steady state, when comparing the main circuit 22 including the main contact 20 with the auxiliary circuit 23 including the auxiliary contact 21, since the auxiliary conductor 7 constituting the auxiliary circuit 23 includes the cylindrical magnetic body 9, the impedance of the auxiliary circuit 23 is high. Accordingly, a substantial part of a current such as a fault current flowing through the disconnecting switch under the steady state flows through the main circuit 22. Thus, when the switch is in this position there is no increase in impedance of the disconnecting switch to an unduly high amount with respect to the fault current and thereby there is a reduced likelihood that an additional recovery voltage will appear between the contacts of a circuit breaker 24 in the system as shown schematically in FIGS. 2(*a*), 2(*b*) and 2(*c*) after the fault current passes the zero point and that the interruption of the fault current will fail.

FIG. 2 (*b*) and FIG. 2 (*c*) show conditions in which the disconnecting switch is on the way of the opening operation wherein at first, the main contact 20 is opened and then the auxiliary contact 21 is opened respectively.

Namely, when the disconnecting switch is operated by moving the moving member 12 to open the switch in, the moving member 12 begins to move to the arrowed direction in FIG. 1 from the rightwardly displaced condition described above and illustrated in FIG. 2(*a*). Accordingly, for the first time the main movable member 16 is disengaged from the main stationary member 6, thereby opening the main contact 20. This condition is illustrated in FIG. 2 (*b*), accordingly. In this condition all of the current passing through the disconnecting switch is shifted to the auxiliary circuit 23.

Subsequently, when the movable member 12 is moved further in the arrowed direction, the auxiliary movable member 17 finally disengages from the auxiliary stationary member 8 and the auxiliary contact 21 begins to open. This condition is illustrated in FIG. 2 (*c*). In the course of the separation of auxiliary contacts 8 and 17, a restriking arc 18 is generated at the auxiliary contact 21 as shown in FIG. 2(*c*). However, the surge current thereof is reduced through the effect of the cylindrical magnetic body 9 and the restriking surge voltage is surely suppressed.

After the condition as shown in FIG. 2 (*c*) is reached, both the main contact 20 and the auxiliary contact 21 are completely opened and the disconnecting switch is held in an open line condition. Therefore, the present embodiment surely prevents the interruption failure of a circuit breaker disposed in the system without impairing the restriking surge suppressing function of the disconnecting switch by means of the cylindrical magnetic body 9.

In the present invention, several kinds of magnetic materials such as Permalloy, iron and ferrite can be used for the above cylindrical magnetic body 9. However, ferrite is preferable, because ferrite shows a large loss with respect to high frequency current components of several 100 kHz-several 10 MHz.

Further, in the present embodiment, a surge voltage is generated along the longitudinal direction of the cylindrical magnetic body 9. The surge voltage may reach a voltage of about two times the peak value of the operating voltage of the system. Accordingly, it is necessary to maintain a dielectric strength of the main stationary member 6 and the auxiliary stationary member 8 to withstand this voltage.

Further, it is needless to say that the entire constitution of the main stationary member 6 and the main movable member 16 and the auxiliary stationary member 8 and the auxiliary movable member 17 have to be designed while balancing the configuration and size thereof and providing a correct control of the electric field caused thereby which varies dependent upon time so that the restriking arc 18 is not generated between the main stationary member 6 and the auxiliary movable member 17 but surely generated between the auxiliary stationary member 8 and the auxiliary movable member 17.

Figure 3:
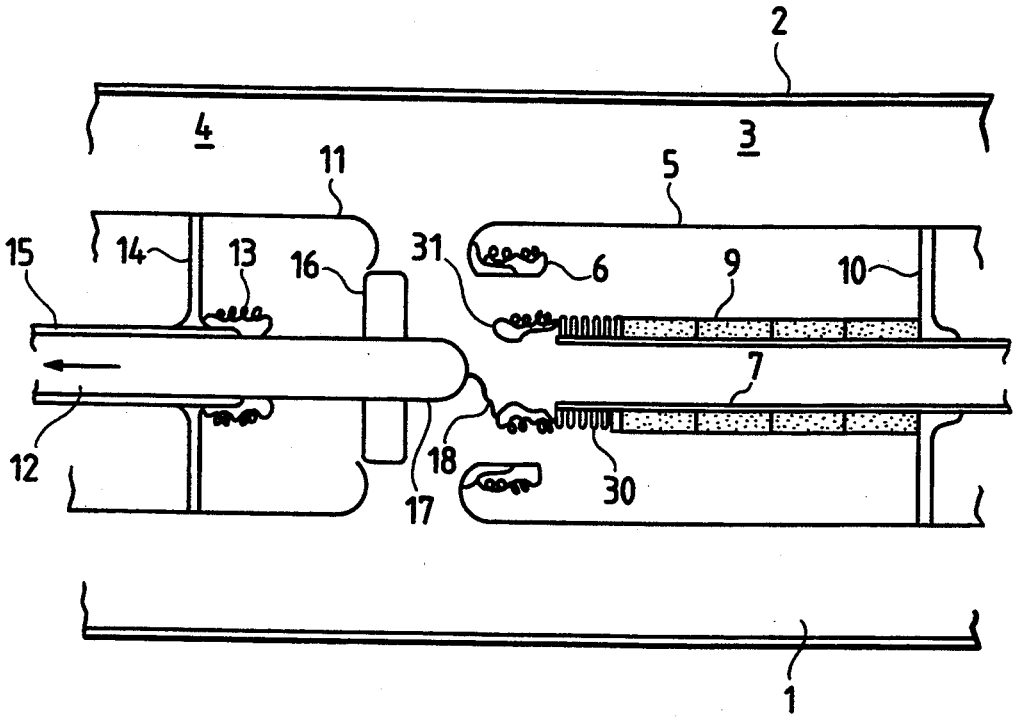
FIG.3 is a lateral cross section showing another embodiment of gas isolated disconnecting switches according to the present invention.

FIG. 3 is another embodiment of the present invention and is a modification of the embodiment as shown in FIG. 1, wherein a follow-up type auxiliary stationary member 31 including a. follow-up spring 30 is provided on the auxiliary conductor 7 in the stationary member side 3. When the movable member 12 begins to move toward the arrowed direction during the line opening operation of the disconnecting switch, the follow-up type auxiliary stationary member 31 follows the auxiliary movable member 17 for a predetermined distance via the extending movement of the follow-up spring 30 in a condition of engagement therewith. Thereafter the follow-up type auxiliary stationary member 31 disengages from the auxiliary movable member 17 via the tensile force of the follow-up spring 30 to restore the member 31 to its original state.

Accordingly, with the embodiment shown in FIG. 3, via the follow-up action of the follow-up type auxiliary stationary member 31 to the auxiliary movable member 17, the opening of the auxiliary contact 21 before the main movable member 16 disengages from the main stationary member 6 is surely prevented thereby eliminating the generation of a restriking arc between the main movable member 16 and the main stationary member 6 and surely and always causing the generation of the restriking arc 18 between the follow-up type auxiliary stationary member 31 and the auxiliary movable member 17.

Figure 4:
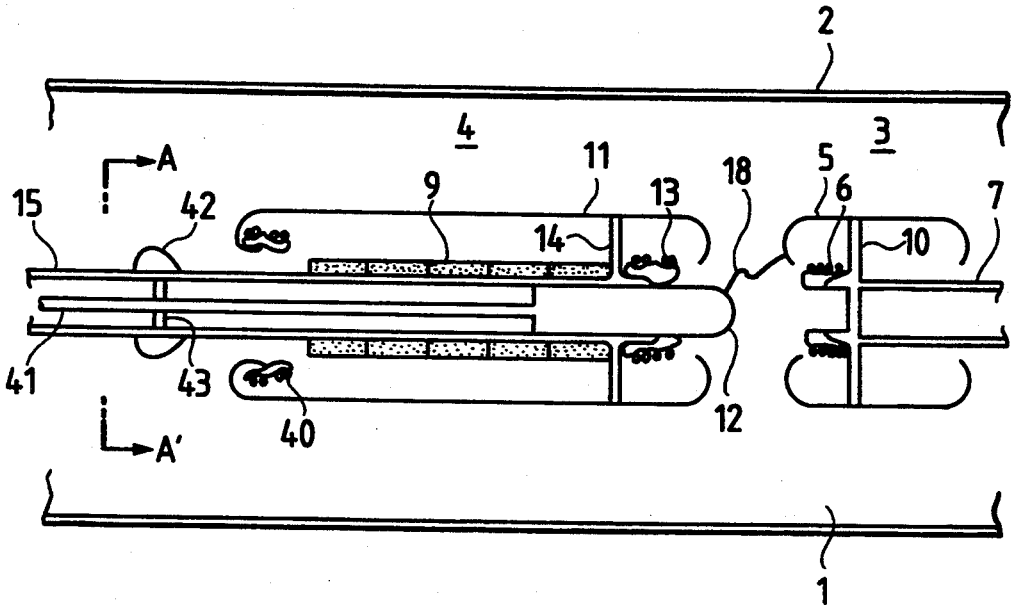
FIG. 4 is a lateral cross section showing a further embodiment of gas isolated disconnecting switches according to the present invention.

In the further embodiment shown in FIG. 4, the cylindrical magnetic body 9 is disposed at the finally departing port ion in the movable member side 4. The left end of the movable member side shield 11 which serves as a conductor is provided with a main stationary contact piece 40. A ring shaped movable main contact piece 42 is fitted on the conductor 15 and is adapted to slide on the outer surface thereof together with the movement of an operating rod 41 of the movable member 12. Therefore, during the closure of the disconnecting switch the main movable contact piece 42 contacts the main stationary contact piece 40. As a result a short-circuiting contact circuit is formed through the movable member 12, the movable member side shield 11, the main stationary contact piece 40 and the main movable contact piece 42. Thus, under the steady state a substantial part of the line current flows through the movable member 12 and the movable member side shield 11 rather than the portion of the conductor 15 which passes through the cylindrical magnetic body 9 to thereby suppress the effect of the cylindrical magnetic body 9.

Figure 5:
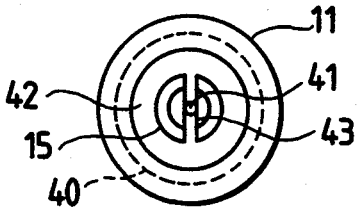
FIG. 5 is a partial side cross section of the further embodiment of gas isolated disconnecting switches according to the present invention taken along the line A—A of FIG. 4.

FIG. 5 is a cross section of the conductor 15 taken along the line A—A' and seen from the arrowed direction in FIG. 4. As will be apparent from the drawing, two slits are formed in the tube like conductor 15 extending along the longitudinal direction and spaced apart in its radial direction. The main movable contact piece 42 is fixed to the operating rod 41 with a supporting rod 43 through these slits so as to permit the movable contact piece 42 a slidable movement together with the operating rod 41.

Figure 6:
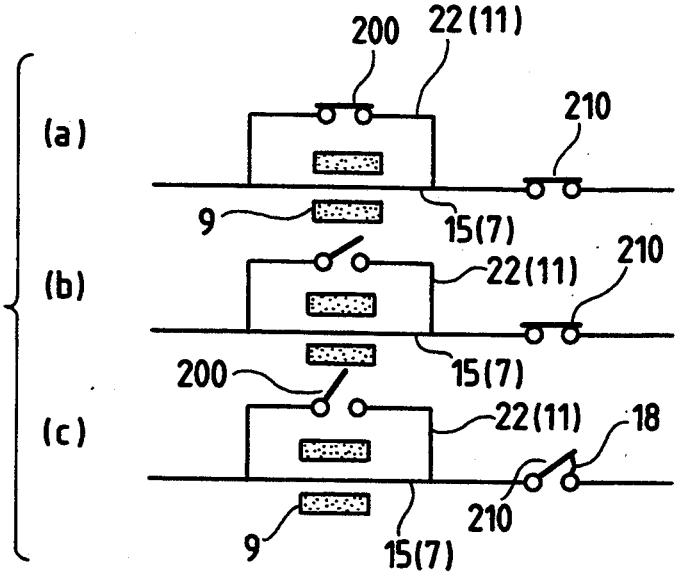
FIGS. 6(*a*), 6(*b*) and 6(*b*) are respective circuit diagrams for explaining the operation of the further embodiment of gas isolated disconnecting switches according to the present invention.

Accordingly, in the same manner as in FIGS. 2(*a*), 2(*b*) and 2(*c*) equivalent circuits of the embodiment shown in FIG. 4 are shown in FIGS. 6(*a*), 6(*b*) and 6(*c*). In the case of the present embodiment, a first main contact 200 is constituted by the main stationary contact piece 40 and the main movable contact piece 42, a second main contact 210 is constituted by the main stationary member 6 and the movable member 12 and further the main circuit 22 is constituted by the movable member side shield 11.

Now, the operation of the embodiment as shown in FIG. 4 is explained. At first, under the steady state in which the disconnecting switch closes the electric power line, the movable member 12 is located at the right side in the drawing via the operation of the operating rod 41. In this position the movable member engages the stationary member 6 and at the same time the main movable contact piece 42 is in a condition of engaging with the main stationary contact piece 40.

Accordingly, at this moment both the first main contact 200 and the second main contact 210 are closed. Therefore, the equivalent circuit therefor is represented as shown in FIG. 6 (*a*). With the contacts 200 and 210 closed, a substantial part of the line current containing a fault current does not flow through the portion of conductor 15 having increased inductance because of the cylindrical magnetic body 9 there around, but flows through the main circuit 22 constituted -by the movable member side shield 11. In this way an increase of the line inductance is totally eliminated and the possibility of inducing an adverse effect on the operation of a circuit breaker disposed within the system and of causing an interruption failure is surely suppressed.

In the opening operation of the disconnecting switch, the operating rod 41 begins to move toward the left in FIG. 4. The mounting position of the main movable contact piece 42 on the operating rod 41 is selected in such a manner that in association with the movement of the operating rod 41 toward the left side, the main movable contact piece 42 is at first separated from the main stationary contact piece 40, and with further movement of the operating rod 41 by a predetermined distance toward the left side the movable member 12 is then separated from the stationary member 6.

As a result, when a circuit opening operation of the disconnecting switch is initiated, the disconnecting switch moves from the condition as shown in FIG. 6 (*a*) to the condition as shown in FIG. 6 (*b*) wherein via the opening of the first main contact 200 all of the current which has been flowing through the main circuit 22 is shifted to the conductor 15, and thereafter as shown in FIG. 6 (*c*) the second main contact 210 begins to open and a restriking arc 18 is generated. However, at this moment all of the current has been shifted to that portion of the conductor 15 which passes through the cylindrical magnetic body 9 and the restriking surge current associated with the opening operation of the disconnecting switch passes through the conductor 15 surrounded by the cylindrical magnetic body 9 so that the circuit opening operation is completed while surely suppressing the restriking surge voltage.

Figure 7:
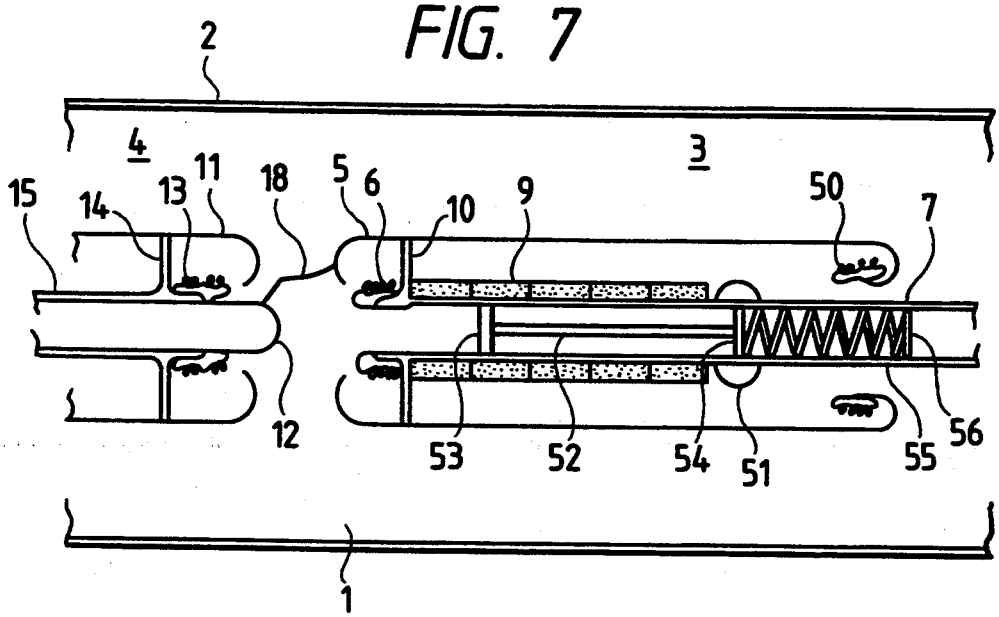
FIG. 7 is a lateral cross section showing a still further embodiment of gas isolated disconnecting switches according to the present invention.

FIG. 7 is a still further embodiment of the present invention in which the cylindrical magnetic body 9 is disposed at the final departing portion of the stationary member side 3. A main stationary contact piece 50 is provided at the opposite side of the stationary member side conductor 5 serving as a shield from the movable member side 4. A ring like main movable contact piece 51 is slidably disposed on the outer circumference of the conductor 7 and is connected to a coupling rod 52.

At the end of the coupling rod 52 facing the movable member 12 a pushing plate 53 is provided and at the opposite end thereof is a supporting rod 54. Through this supporting rod 54 the main movable contact piece 51 is fixed to the coupling rod 52. Further, the entirety of the coupling rod 52 is slidably inserted inside the tube like conductor 7 and is maintained at the illustrated position in the steady state via a return spring 55 held by a stopper 56. The connecting condition between the main movable contact piece 51 and the supporting rod 54 is the same as that of the embodiment shown in FIG. 5 in that they both are connected to each other through the slits provided along the conductor 7.

Now, the operation of the present embodiment as shown in FIG. 7 is explained. First, in the steady state in which the disconnecting switch closes the circuit, the movable member 12 is located at the right side of the drawing where it engages the stationary member 6 and contacts the pushing plate 53 so that the coupling rod 52 is moved toward the right side of the drawing against the reaction force of the spring 55 to engage the main movable contact piece 51 with the main stationary contact piece 50.

The above condition corresponds to the circuit condition as shown in FIG. 6 (*a*) if explained with reference to FIGS. 6 (*a*), 6 (*b*) and 6 (*c*) in the same manner as in the embodiment as shown in FIG. 4. Further, in the embodiment as shown in FIG. 7, the first main circuit 200 is composed by the main stationary contact piece 50 and the main movable contact piece 51, the second main contact 210 is composed by the stationary member 6 and the movable member 12 and the main circuit 22 is composed by the stationary member side conductor 5 serving as a shield and the mounting bracket 10.

Accordingly, in this steady state a substantial part of the line current flows through the main circuit 200 having a low impedance. This main circuit is formed through the movable member 12, the stationary member 6, the mounting bracket 10, the stationary member side conductor 5 serving as a shield, the main stationary contact piece 50 and the main movable contact piece 51, as the short-circuiting contact circuit. The effect of the cylindrical magnetic body 9 is suppressed under the steady state and the possibility of inducing an adverse effect on the interrupting operation of a circuit breaker within the system is sufficiently eliminated.

During the circuit opening operation of the disconnecting switch, when the movable member 12 begins to move toward the left side in FIG. 7 from the condition that the movable member 12 engages with the stationary member 6, the coupling rod 52 also begins to return toward the left side following the movement of the movable member 12 via the action of the spring 55. The main movable contact piece 51 at first disengages from the main stationary contact piece 50, and then the movable member 12 also disengages from the stationary member 6. This condition is illustrated in the drawing. Accordingly, the operating conditions sequentially move from the steady state as shown in FIG. 6 (*a*) to those shown in FIG. 6 (*b*) and FIG. 6 (*c*). Therefore, the restriking surge current during the circuit opening operation by the disconnecting switch flows through the conductor surrounded by the cylindrical magnetic body 9, and the restriking surge voltage is surely suppressed.

Further, in the embodiments as shown in FIG. 1 and FIG. 3, the auxiliary stationary member 8 and the auxiliary movable member 17, and the follow-up type auxiliary stationary member 31 and the auxiliary movable member 17 are constituted as a matter of fact, to be in a contacting condition under the steady state. However, these may be designed so as not to contact each other mechanically by keeping a small gap therebetween. When the constitution of these auxiliary members is modified in this manner, the circuit constituted by the auxiliary stationary member 8 and the auxiliary movable member 17 or the follow-up auxiliary stationary member 31 and the auxiliary movable member 17 is always kept open during the steady state so that current never flows therethrough and further no possibility of contact wear arises.

Still further, the embodiments shown in FIG. 1 through FIG. 7 show applications of the present invention to gas isolated disconnecting switches. However as will be apparent from FIG. 6, it will be understood that the present invention is applicable to a general gas isolated power transformation system. Namely, even in a case that a cylindrical magnetic body is provided on a gas isolated bus-bar conductor at any desired position so as to suppress the restriking surge caused by a gas isolated disconnecting switch, with the provision of a contact connected in parallel with the conductor, the objects of the present invention are achieved. Accordingly, hereinbelow one embodiment of gas isolated switching devices constituted by applying the present invention to a general gas isolated power transformation system is shown in FIG. 8.

Figure 8:
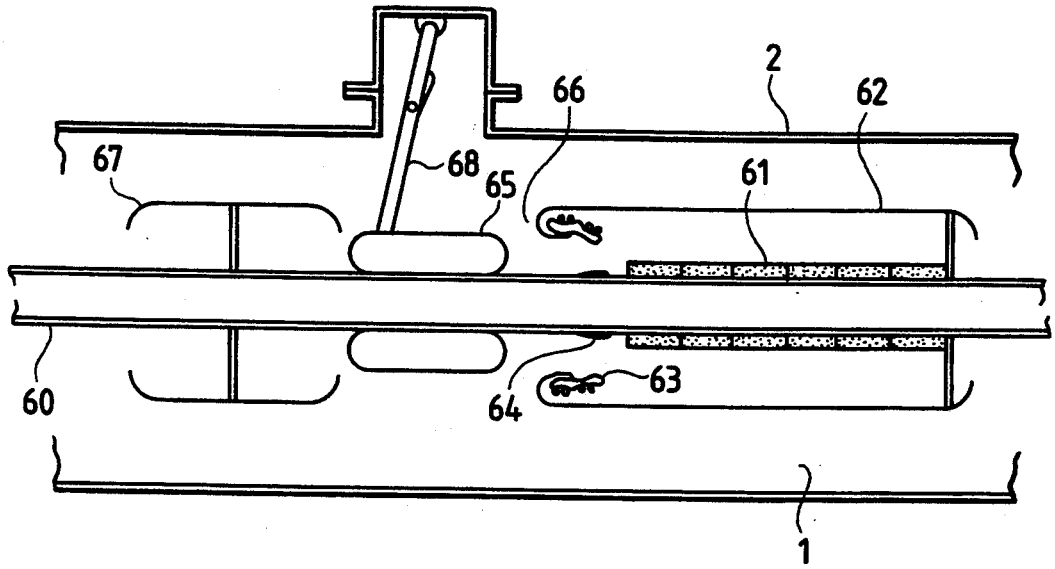
FIG. 8 is a lateral cross section showing one embodiment of gas isolated switching devices according to the present invention.

In FIG. 8, a gas isolated bus-bar conductor 60 located at any desired position within the system is provided with a cylindrical magnetic body 61 which is covered with a shield. The shield 62 serves as a conductor for maintaining isolation from the grounded tank 2. Further, the shield 62 and the conductor 60 are respectively provided with contact pieces 63 and 64 and the conductor 60 is further provided with an annular movable member 65 slidable thereon.

When the movable member 65 is moved rightward in the drawing, the movable member 65 contacts both contact pieces 63 and 64 thereby forming a short-circuiting contact circuit 66 which bypasses a portion of the conductor 60 which passes through the cylindrical magnetic body 61. Further, in the present embodiment, a shield 67 is provided near the movable member 65 at the opposite side from the side facing the shield 62 so as to isolate the grounded tank 2. The movable member 65 is slidably moved via an insulated operating rod 68 so as to make and break the contact circuit 66.

Figure 9:
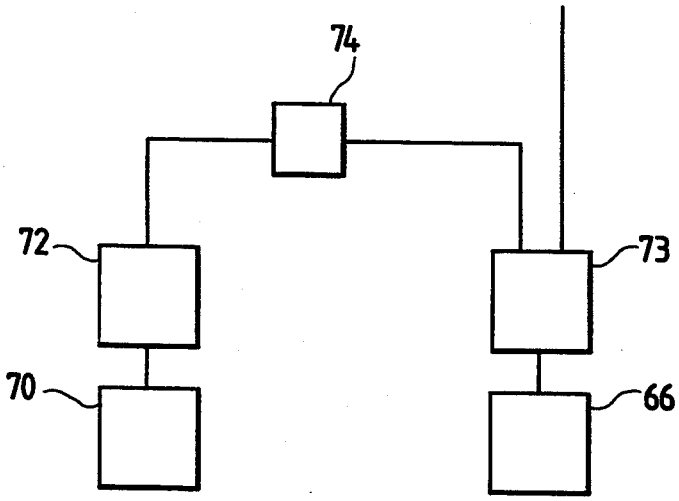
FIG. 9 is a block diagram for explaining a control system for the one embodiment of gas isolated switching devices according to the present invention.

Now, the operation of the present embodiment is explained. The contact circuit 66 is controlled in such a manner that, under the steady state in which a gas isolated disconnecting switch connected in series with the gas isolated bus-bar conductor 60 is closed, a substantial part of a current such as a fault current does not pass through the a portion of the conductor 60 surrounded by the ring like magnetic body 61 except for the region in which such fault current approaches zero. During the transient state of circuit opening operation by the disconnecting switch the restriking surge current is caused to pass through the portion of the conductor 60 surrounded by the ring like magnetic body 61. For this purpose, between operating circuits 72 and 73 for the respective gas isolated disconnecting switch 70 and contact circuit 66 a delay circuit 74 is provided as shown in FIG. 9 so as to perform a control sequence to open the contact circuit 66 immediately before the opening of the gas isolated disconnecting switch 70.

Therefore, according to the present embodiment, with the provision of the ring like magnetic body 61 on the conductor located at any desired position in a gas isolated switching device, a possible restriking surge voltage is effectively suppressed.

Now, the restriking surge voltage suppressing effect with the above described embodiments is explained. When the loss caused by the above cylindrical magnetic body with respect to the surge current which is converted to an equivalent resistance is selected to be equal to or more than the surge impedance of the gas isolated bus-bar, the restriking surge voltage is suppressed below 2 pu (wherein 1 pu is a peak value of the operating voltage of the system with respect to the ground).

According to the present invention, in a gas isolated disconnecting switch and a gas isolated switching device which incorporate a cylindrical magnetic body, the effect of the cylindrical magnetic body is suppressed during the steady operating state so that an additional increase of a recovery voltage appearing at a circuit breaker during interruption of a fault current, for example, is eliminated because of the existence of the cylindrical magnetic body and such fault current is interrupted by the circuit breaker as usual. On the other hand, during the opening and closing operation of the disconnecting switch the effect of the cylindrical magnetic body is brought about to sufficiently suppress the restriking surge voltage caused at the gas isolated disconnecting switch.

We claim:

1. A gas isolated switching device of a power transformation system, comprising a gas isolated bus-bar conductor within the system, a cylindrical magnetic body about a portion of the bus-bar conductor for suppressing restriking surge at a disconnecting switch in said system, a short-circuiting contact circuit which by-passes said conductor portion passing through said cylindrical magnetic body, said short-circuiting contact circuit being constituted to initiate a contact opening operation prior to a contact opening operation of said disconnecting switch and to hold the contact opening condition of the short circuiting contact circuit during the interval when said disconnecting switch is in the contact opening condition, wherein a conductive line of said short-circuiting contact circuit is constituted by a cylindrical conductive body which serves as a shielding member for said cylindrical magnetic body.

2. A gas isolated switching device according to claim 1 wherein contacts of said short-circuiting contact circuit are constituted by a main stationary member formed at an end of the cylindrical conductive body which serves as a shielding member for said cylindrical magnetic body and an annular movable member which moves slidably along the bus-bar conductor near the conductor portion passing through said cylindrical magnetic body.

3. A gas isolated disconnecting switch comprising a conductor, a disconnecting switch disposed in series with said conductor, a cylindrical magnetic body about a portion of the conductor for suppressing a restriking surge, a short-circuiting contact circuit which bypasses the conductor portion passing through said cylindrical magnetic body, said short-circuiting contact circuit being constituted to initiate a contact opening operation prior to a contact opening operation of said disconnecting switch and to hold the contact opening condition of the short circuiting contact circuit during the interval when said disconnecting switch is in the contact opening condition, wherein a conductive line of said short-circuiting contact circuit is constituted by a cylindrical conductive body which serves as a shielding member for said cylindrical magnetic body and contacts of said short-circuiting contact circuit which are constituted by a main stationary member formed at an end of the cylindrical conductive body which serves as a shielding member for said cylindrical magnetic body and a main movable member engagable with said main stationary member and secured at a movable member, and further an auxiliary movable member formed at one end of said movable member.

4. A gas isolated disconnecting switch according to claim 3, wherein said auxiliary movable member and an auxiliary stationary member located at an end of the conductor on which said cylindrical magnetic body is mounted are constituted so as to maintain a non-contacting condition with a narrow gap therebetween even in a steady state during the contact closing of the disconnecting switch.

5. A gas isolated switching device comprising a gas-isolated bus-bar conductor within the system, a cylindrical magnetic body about a portion of the bus-bar conductor for suppressing a restriking surge at a disconnecting switch in said system, a short-circuiting contact circuit which by-passes said conductor portion passing through said cylindrical magnetic body, said short-circuiting contact circuit being constituted to initiate a contact opening operation prior to a contact opening operation of said disconnecting switch and to hold the contact opening condition of the short-circuiting contact circuit during the interval when said disconnecting switch is in the contact opening condition, wherein said cylindrical magnetic body is composed of a ferrite core material which increases a loss due to the resistance component with respect to a current in said bus-bar conductor having a high frequency component more than several 10 kHz.

6. A gas isolated disconnecting switch comprising a conductor, a disconnecting switch disposed in series with said conductor, a cylindrical magnetic body about a portion of the conductor for suppressing a restriking surge, a short-circuiting contact circuit which by-passes the conductor portion passing through said cylindrical magnetic body, said short-circuiting contact circuit being constituted to initiate a contact opening operation prior to a contact opening operation of said disconnecting switch and to hold the contact opening condition of the short circuiting contact circuit during the interval when said disconnecting switch is in the contact opening condition, wherein said cylindrical magnetic body is composed of a ferrite core material which increases a loss due to the resistance component with respect to a current in said conductor having a high frequency component more than several 10 kHz.

7. A gas isolated switching device according to any one of claims 1 or 2, wherein said cylindrical magnetic body is formed such that it causes a loss as a result of a surge which loss is converted to an equivalent resistance which is equal to or greater than the surge impedance of said conductive bus-bar.

8. A gas isolated disconnecting switch according to any one of claims 2 through 6, wherein said cylindrical magnetic body is formed such that it causes a loss as a result of a surge which loss is converted to an equivalent resistance which is equal to or greater than the surge impedance of a conductive bus-bar in the system.

9. A gas isolated disconnecting switch according to claim 3, wherein an auxiliary stationary member engagable with said auxiliary movable member is disposed at an end of the conductor on which said cylindrical magnetic body is mounted.

10. A gas isolated disconnecting switch according to claim 9, wherein said auxiliary stationary member is a follow-up type auxiliary stationary member including a follow-up spring and follows said auxiliary movable member by a predetermined distance via the extending movement of said follow-up spring after the separation of said short-circuiting contact circuit.

* * * * *